US011260272B2

(12) United States Patent
Robinson

(10) Patent No.: US 11,260,272 B2
(45) Date of Patent: Mar. 1, 2022

(54) SYSTEM AND METHOD OF USE FOR SWIMMER WINGS

(71) Applicant: Weston Robinson, Longview, WA (US)

(72) Inventor: Weston Robinson, Longview, WA (US)

( * ) Notice: Subject to any disclaimer, the term of this patent is extended or adjusted under 35 U.S.C. 154(b) by 96 days.

(21) Appl. No.: 16/728,669

(22) Filed: Dec. 27, 2019

(65) Prior Publication Data

US 2020/0206570 A1 Jul. 2, 2020

Related U.S. Application Data

(60) Provisional application No. 62/786,337, filed on Dec. 29, 2018.

(51) Int. Cl.
*A63B 31/10* (2006.01)

(52) U.S. Cl.
CPC ..... *A63B 31/10* (2013.01); *A63B 2208/03* (2013.01); *A63B 2209/00* (2013.01)

(58) Field of Classification Search
CPC ..... A63B 31/08; A63B 31/10; A63B 31/12; A63B 2208/03; A63B 2209/00; A63B 2209/02; A63B 2209/10; A63B 2225/09
USPC ..... 441/55–59
See application file for complete search history.

(56) References Cited

U.S. PATENT DOCUMENTS

| | | | | | |
|---|---|---|---|---|---|
| 2,620,495 | A * | 12/1952 | Loiselle | A63B 31/08 | 441/59 |
| 3,529,313 | A * | 9/1970 | Girden | A63B 31/08 | 441/58 |
| 3,789,448 | A * | 2/1974 | Mitchell | A63B 31/10 | 441/59 |
| 3,922,740 | A * | 12/1975 | Potter | A63B 31/08 | 441/58 |
| 7,361,070 | B2 * | 4/2008 | Bolstor | A63B 31/10 | 440/101 |
| 8,123,635 | B2 * | 2/2012 | Gillis | A63B 69/00 | 473/450 |
| 2012/0094560 | A1 * | 4/2012 | Sherstnev | A63B 31/10 | 441/58 |

* cited by examiner

*Primary Examiner* — Ajay Vasudeva
(74) *Attorney, Agent, or Firm* — Christopher Mayle; Bold IP, PLLC

(57) ABSTRACT

A system and method for two swimmer wings designed using biomimicry and inspired by winged creatures/birds of flight as well as the fore flippers of a sea turtle. The swimmer wings are designed for users to traverse long distances instead of relying on personal watercrafts or boats to not only help sustain the environment by reducing the carbon footprint but also provide physical exercise to improve the user's well-being. The swimmer wings include a board, an arm guard which shields the user's forearm, and arm fasteners that secure the user's forearm between the board and the arm guard.

14 Claims, 12 Drawing Sheets

SYSTEM AND METHOD OF USE FOR SWIMMER WINGS

CROSS REFERENCE TO RELATED APPLICATIONS

This application is a non-provisional application which claims priority to U.S. Provisional Application No. 62/786,337 filed on Dec. 29, 2018, which is incorporated by reference in its entirety.

FIELD OF DISCLOSURE

The field of disclosure is generally directed to swimming apparatuses. More particularly, the present invention relates to swimmer wings for improved stroke and mobility at reduced exertion to swimmers.

BACKGROUND

Swimming originally was used as a type of navigation for reaching remote locations as well as a crucial skill for early human survival when escaping predators and searching for food. Now, swimming is more recreational in nature and provides an alternative dynamic exercise to running that proves less taxing on the joints. Today's swimmers are now pushing the limits to what is possible through technology. Whether it is clothes that are designed to significantly reduce drag, thus allowing the swimmer to move faster, wearables that monitor oxygen rate and stroke variation, or aquatic fitness equipment which improve muscle structure, swimming has greatly evolved over the past years.

Currently, there are swimming apparatuses that vastly improve the performance speed of the swimmer, but these devices are usually worn on the legs or feet, offering less dexterity and mobility than an apparatus connected to a swimmer's arm. This is because the knee joint lacks the pronation and supination movement of an elbow joint. These types of movement allow a person to turn over their hand from palm down to palm up, providing enhanced freedom of movement of the hands that is not capable with feet. Other devices are positioned around the swimmer's hands, but these can prove unwieldy due to increasing pressure applied at the hand, leading to negative strokes that reduce efficiency. These devices can also be very cumbersome and complex as well as difficult to attach and remove from the user. Thus, to optimize the performance and speed of a swimmer, it would be desirable to develop a swimmer wing that is worn parallel and runs perpendicular to the forearm with an adjustable strap that can be quickly and easily adjusted while protecting the swimmer's forearms.

SUMMARY

The disclosure presented herein relates to a swimmer wing to traverse through a body of water, comprising, the swimmer wing having a board, the board connected to one or more arm fasteners, the one or more arm fasteners connected to an arm guard, the one or more arm fasteners configured to secure a user's forearm between the board and the arm guard, the arm guard configured to shield a top of the user's forearm, the one or more arm fasteners having one or more hook and loop fastener assemblies, the hook and loop fastener assemblies each having a flap and a band, the flap an elongated strip having a patch of gripping fabric comprised of a series of loops and a series of hooks that are configured to mate with each other, the user's forearm positioned between the flap and the band and the board, the arm guard a rigid shell contoured in a convex concave shape having an outer perimeter and inner perimeter, an insert removably attached to the inner perimeter of the arm guard, the insert configured to facilitate adaption of the user's forearm, the insert made of a sweat absorbent material, the board curved and elongated in shape acting as a hydrodynamic wing to generate thrust to the user, the board having a notch configured to reduce spanwise flow and generate vortices and increase flow energy, the board having a flap configured to adjust the curvature of the swimmer wing to better scoop fluid and increase lift, the flap positioned so that the flap is accessible to the user's forearm when secured in the one or more fasteners.

The disclosure also relates to a first and second swimmer wing to traverse through a body of water, comprising, the first and second swimmer wing each having a board, the board connected to one or more arm fasteners, the one or more arm fasteners configured to secure a user's forearms between the board, a sleeve removably attached to the one or more arm fasteners, the sleeve configured to facilitate adaption of the user's forearm while providing durability and compression to the user's arm, the board having notch, fence, or dogtooth configured to reduce spanwise flow and generate vortices and increase flow energy, the board having a flap configured to adjust the curvature of the swimmer wing to better scoop fluid and increase lift, the flap having a grasping side on the top surface of the board and gripping side on the bottom surface of the board, the flap having flexible body portion that bends along its length from the bottom edge to the end of flexible body portion, and the one or more arm fasteners are one or more binding assemblies each having an arm strap, an arm buckle, and ratchet strap, the arm buckle configured to receive the ratchet strap in a sliding engagement that releasably secures the ratchet strap to the arm strap.

The preceding and following embodiments and descriptions are for illustrative purposes only and are not intended to limit the scope of this disclosure. Other aspects and advantages of this disclosure will become apparent from the following detailed description.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
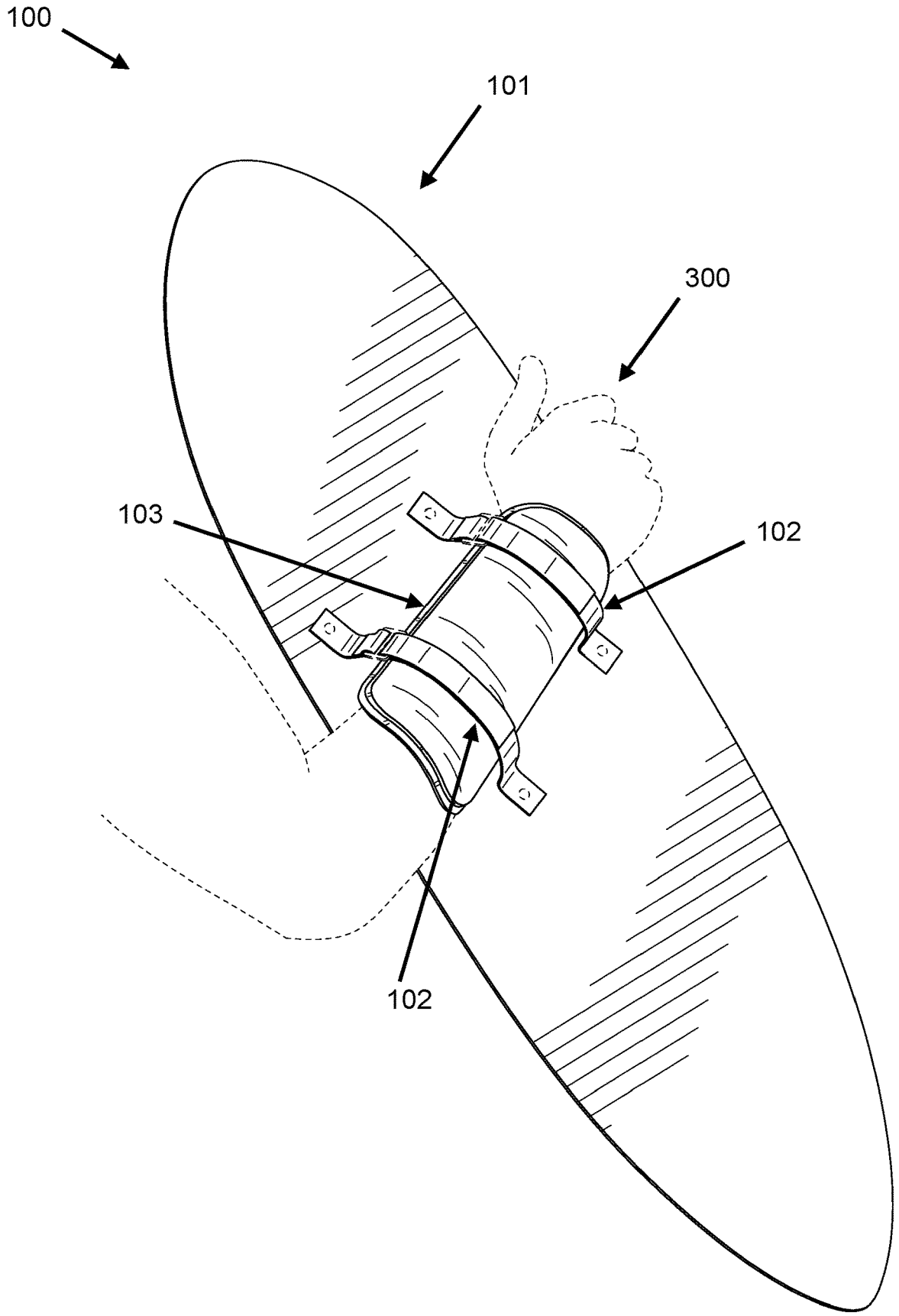
FIG. 1 is a perspective view of an embodiment of a swimmer wing as worn by a user.
Figure 2:
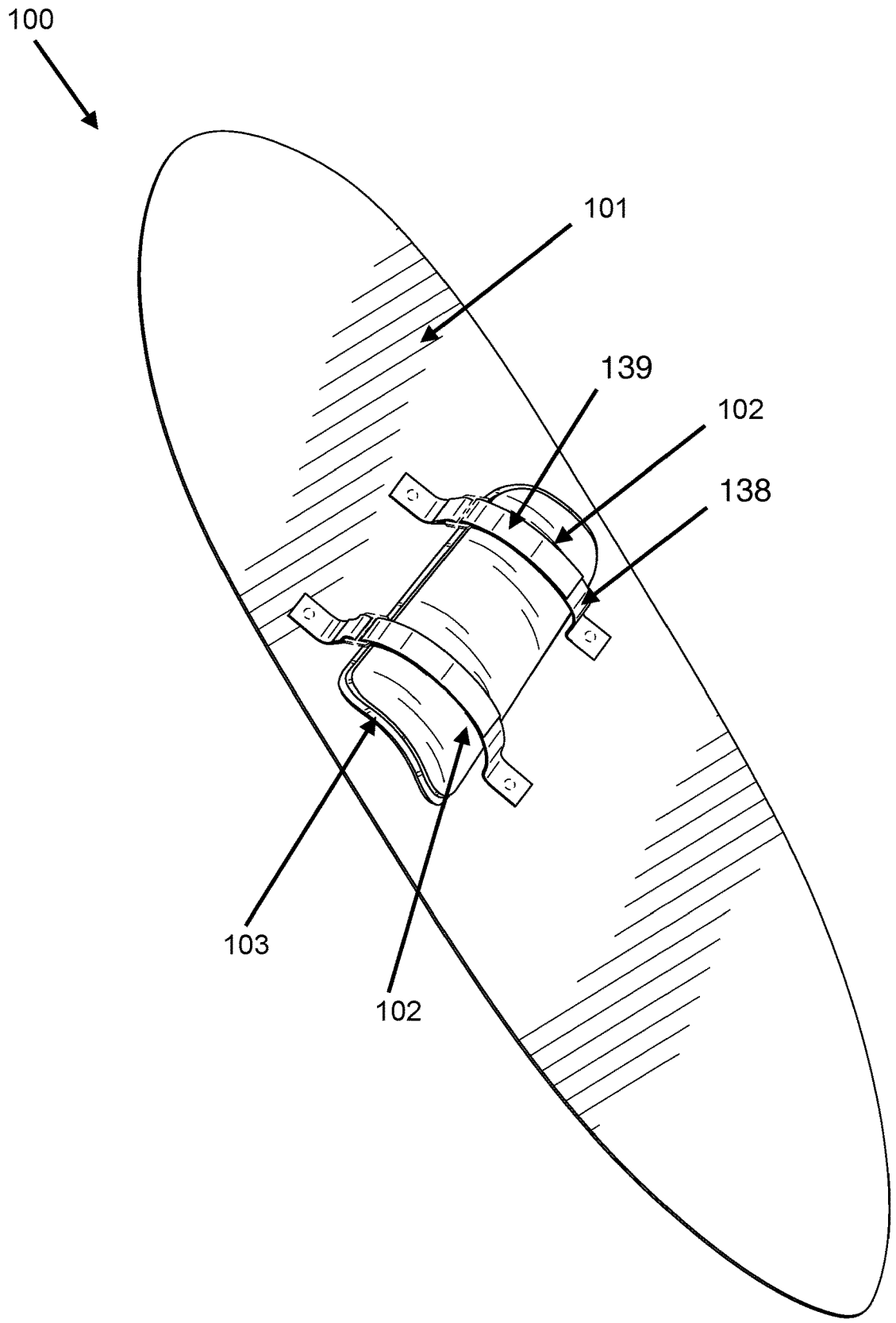
FIG. 2 is a perspective view of an embodiment of a swimmer wing.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present disclosure is generally directed to a system and method, according to one or more exemplary embodiments, for a swimmer wing designed using biomimicry and inspired by winged creatures/birds of flight as well as the fore flippers of a sea turtle. Sea turtles use their fore flippers as paddles, increasing the pulling resistance of their stroke enabling sea turtles to move more quickly through water. Sea turtles usually glide through water at low speeds but can move upwards of 22 miles per hour in short bursts, which can be very beneficial when migrating thousand miles for nesting over the course of a year. Notably the system is used for enhanced mobility, dexterity, and speed while traversing through a body of water for recreational, navigational, or exercise purposes. The swimmer wing is designed for users to traverse long distances instead of relying on personal watercrafts or boats to not only help sustain the environment by reducing the carbon footprint but also provide physical exercise to improve the user's well-being.

With reference now to FIG. 1, one exemplary embodiment of the system according to the present invention is generally designated. The system may include one or more swimmer wings such as swimmer wing 100, each swimmer wing 100 having a board such as board 101, one or more arm fasteners such as arm fasteners 102, and an arm guard such as arm guard 103. Board 101 may be curved and elongated in shape and used as hydrodynamic wings to generate thrust for a user such as user 300 shown in FIG. 1. The shape of board 101 may be of different design and made up of one or more components jointed or fastened together, but must be properly sized and in place to displace surrounding water. Board 101 may be made of a wooden material such as ash, walnut, cherry, maple, or other material that provides stiffness, strength, and durability. This example is however non-limiting and board 101 may be made of other materials such as carbon fiber, metal, plastic, composites, or any other material exhibiting high strength to weight ratio suitable for traversing through water.

Figure 17:
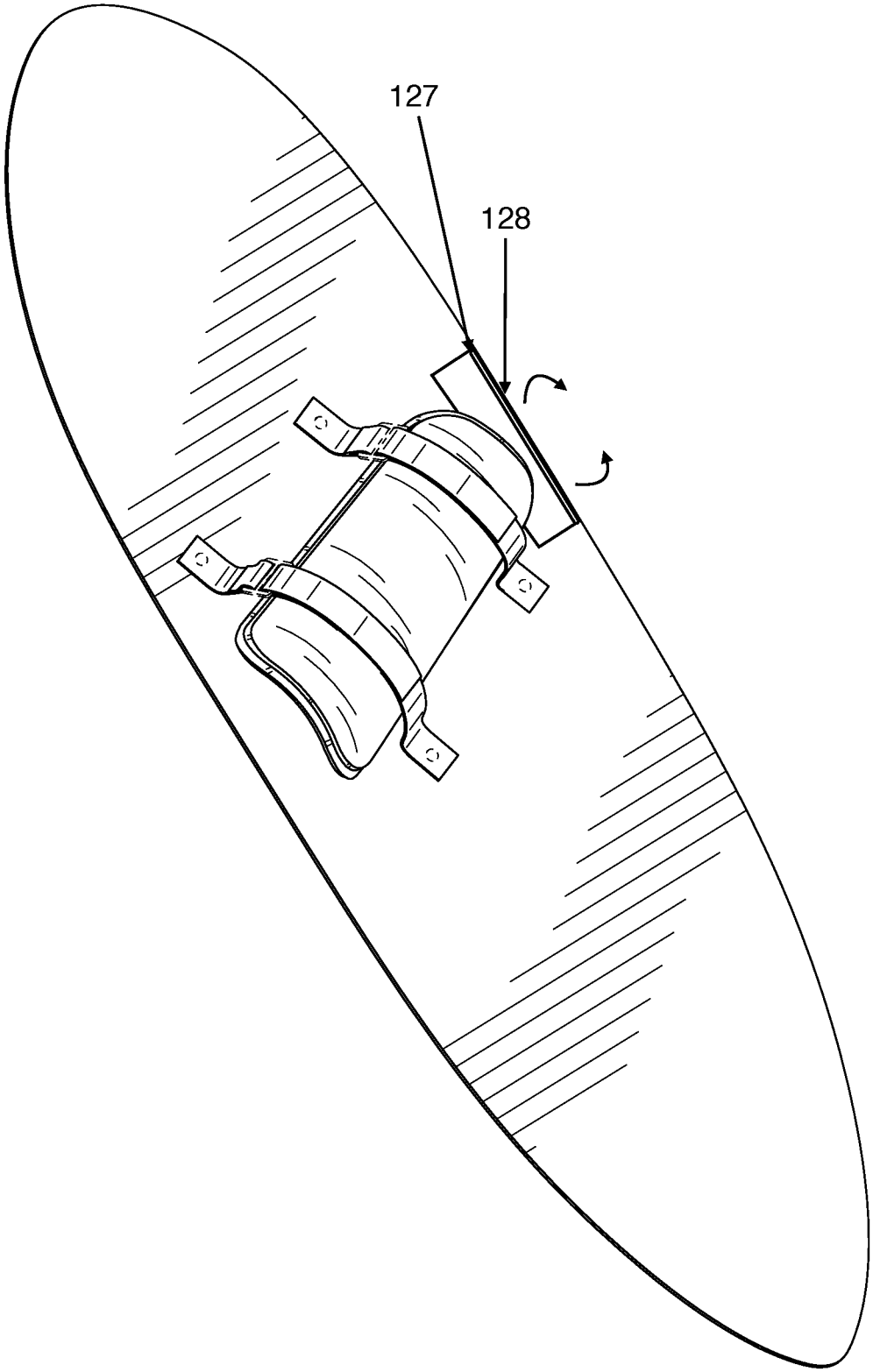
FIG. 17 is a perspective view of a swimmer wing having an adjustable flap.

In some embodiments, board 101 may have a notch, fence, or dogtooth used to reduce spanwise flow and generate vortices that increase flow energy entrained downstream, increasing forward momentum of user 300 while traversing through a body of water. In further non limiting embodiments, board 101 may have a winglet, flap, or camber used to adjust curvature of swimmer wing 100 to better scoop fluid and increase lift, as illustrated in FIG. 17.

A flap such as flap 127 may be utilized as a gripping device whereby flap 127 may have a gripping side and grasping side that user's 300 forearm may reach on the perimeter of board 101. The grasping side may be on the top surface of board 101 and gripping side may be on the bottom surface of board 101, however both sides may be used for grasping and gripping. The flap may have a flexible body portion that bends along its length from the bottom edge to the top end of the flexible body portion. A roller bar cushion such as roller bar 128 or other apparatus may be positioned at the end of the flexible body portion so as to provide cushioning for user 300 as well as facilitate better grip. User's 300 hand while holding the flap may curl forward for a downstroke of swimmer wing 100, whereby the flap moves along synchronously with user's 300 hand. User's 300 hand while holding the flap may pull back for an upstroke of swimmer wing 100 whereby the flap will also move along synchronously with user's 300 hand.

In one or more non-limiting embodiments, arm fasteners 102 may utilize a hook and loop fastener closure system commonly known by the trademark Velcro®. The hook and loop fastener closure system may have one or more hook and loop fastener assemblies, each assembly including a flap 139 and a band 138. Flap 139 and a band 138 may be constructed with nylon and polyester or any suitable material commonly known in the art. Flap 139 and band 138 in each assembly may be affixed to the board with, for example, fasteners, adhesive, latches, hinges, welding techniques, or any other method known to those skilled in the art whereby the flap and band are securely affixed to board 101. Flap 139 and band 138 may also be affixed to a mounting structure on the surface of the board 101.

Flap 139 may be an elongated strip having a patch of gripping fabric comprised of a series of loops and series of hooks that are capable of mating with each other. The series of loops may be attached to the lower surface of flap 139 while band 138 may be an elongated strip having a gripping fabric comprised of a series of hooks attached to the upper surface of band 138. Attaching flap 139 and band 138 together thereby secures a forearm of user 300 who has positioned their forearm between attached flap 139 and band 138 and board 101. Flap 139 and band 138 are attached until a force is provided that overcomes the attraction between flap 139 and band 138 such as by an upward and backward pull on the flap from band 138. It should be appreciated that in other non-limiting embodiments the lower surface of flap 139 may instead have a gripping fabric comprised of a series of hooks while the upper surface of the band may have a series of loops, capable of mating to each other.

In further embodiments arm fasteners 102 may utilize a single piece Velcro® strip with a gripping fabric comprised of a series of hooks and a gripping fabric comprised of a series of loops whereby the single piece may fold over itself whereby the grips and loops mate with each other.

Figure 3:
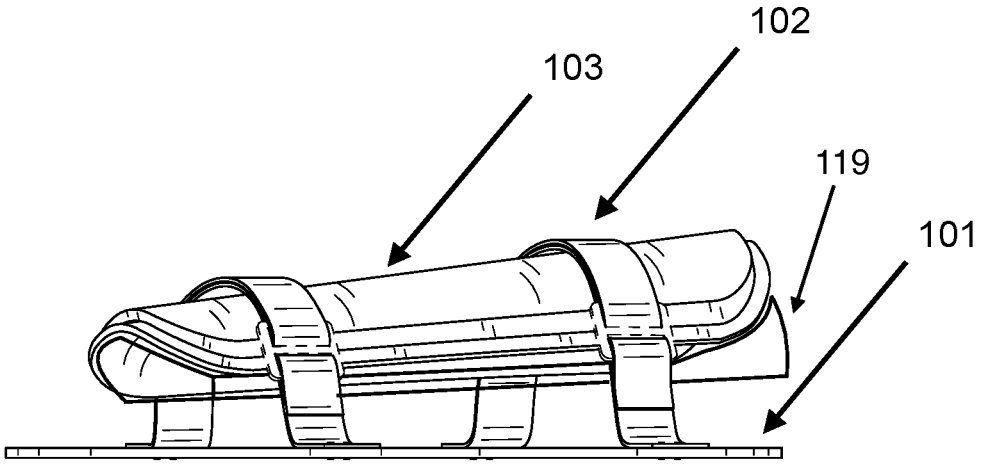
FIG. 3 is a perspective side view of the left side of an embodiment of a swimmer wing.
Figure 4:
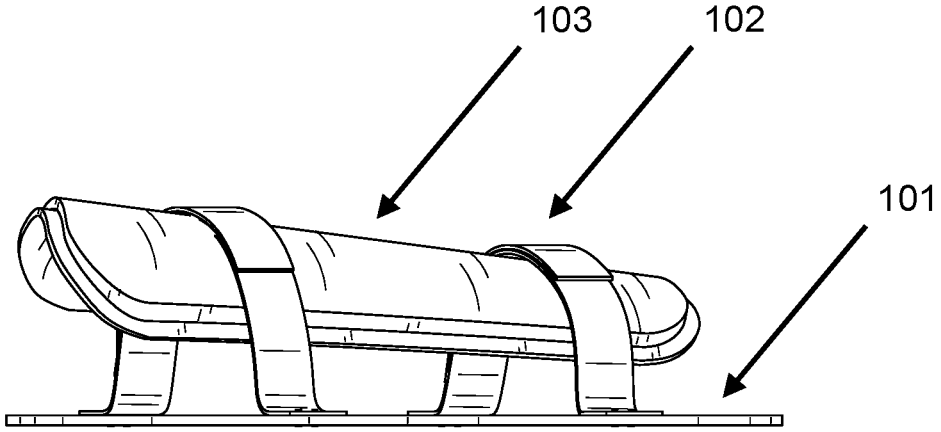
FIG. 4 is a perspective side view of the right side of an embodiment of a swimmer wing.
Figure 5:
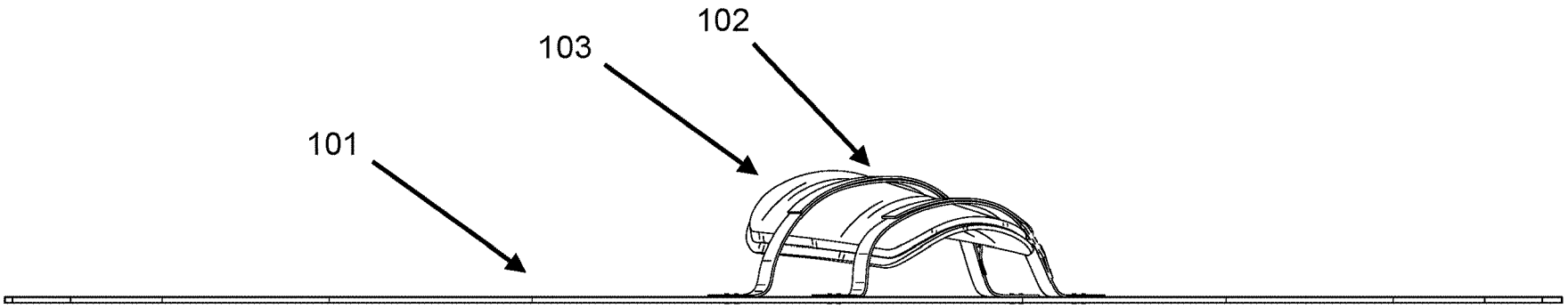
FIG. 5 is a side view of the left side of an embodiment of a swimmer wing.
Figure 6:
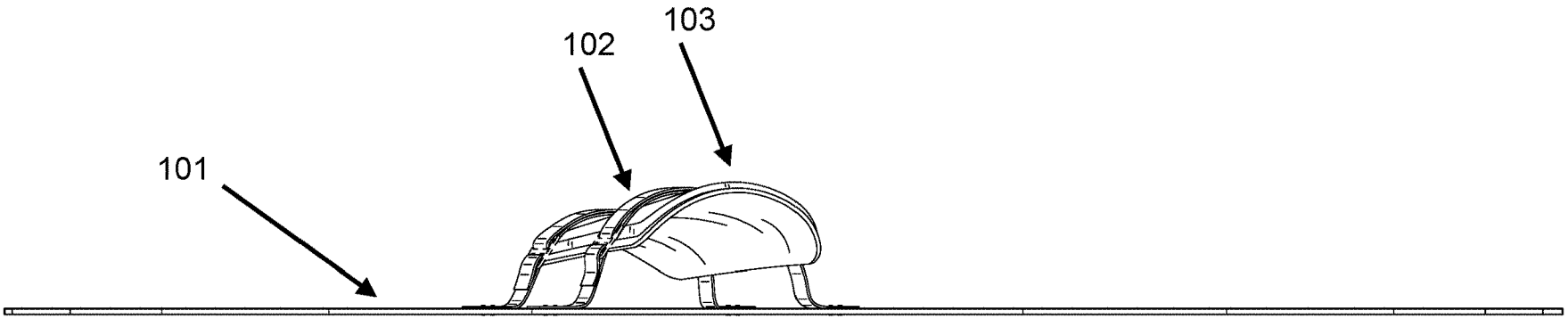
FIG. 6 is a side view of the right side of an embodiment of a swimmer wing.
Figure 7:
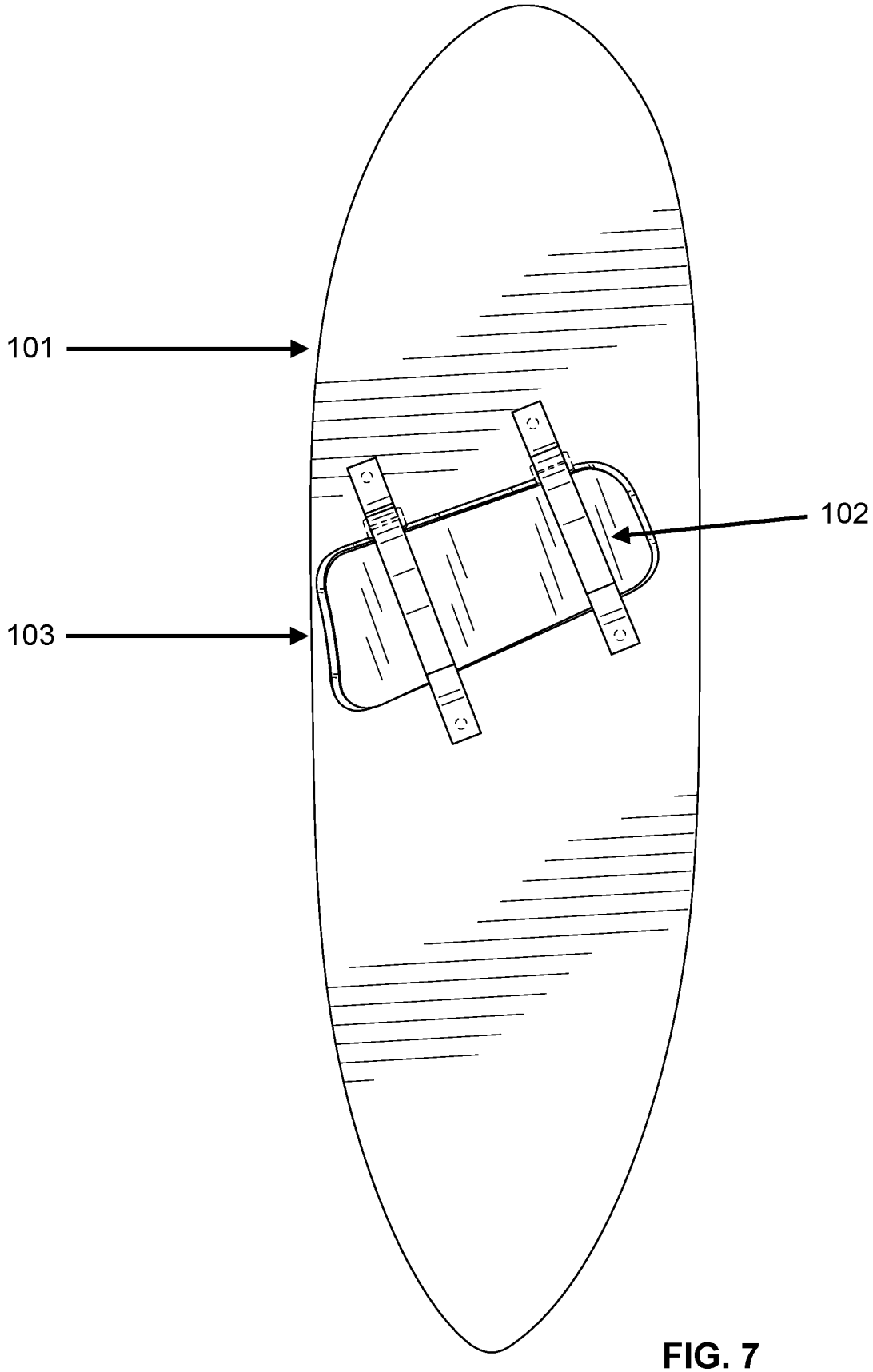
FIG. 7 is a top view of an embodiment of a swimmer wing.
Figure 8:
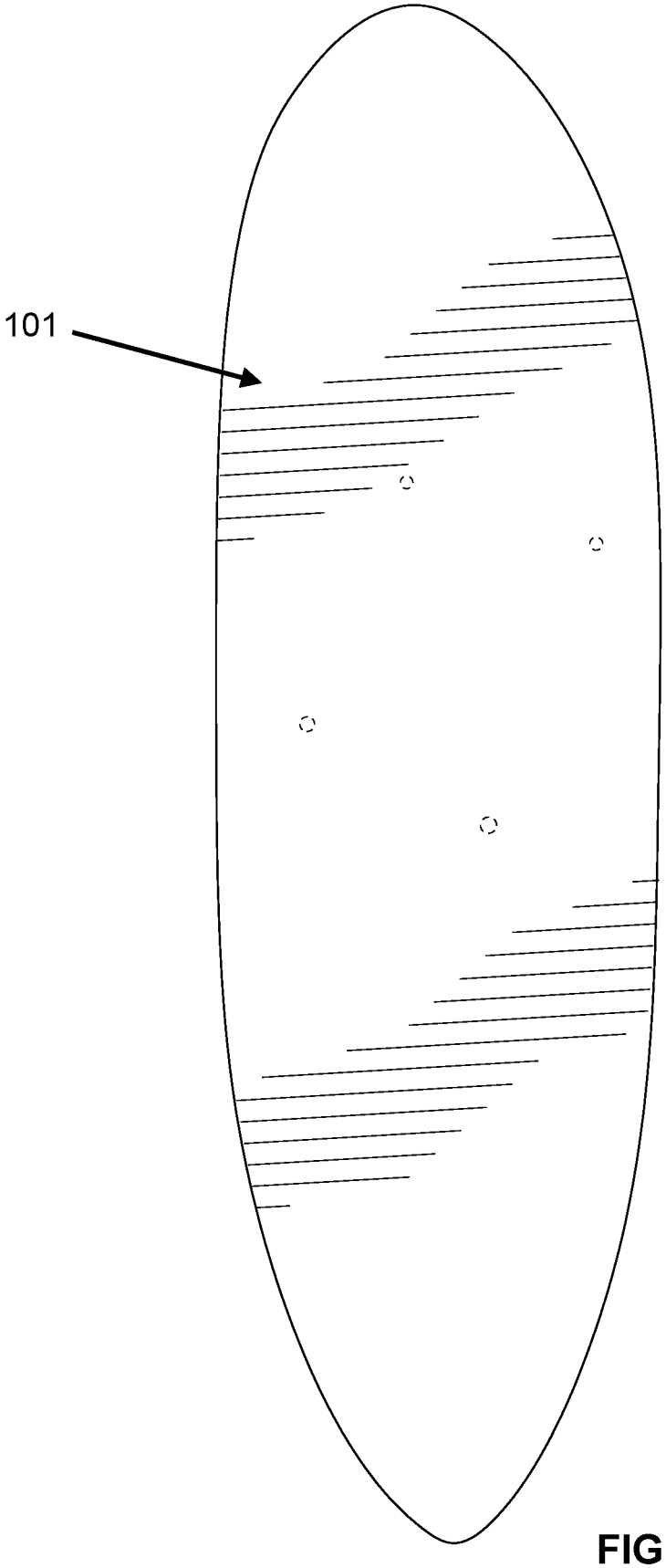
FIG. 8 is a bottom view of an embodiment of a swimmer wing.
Figure 9:
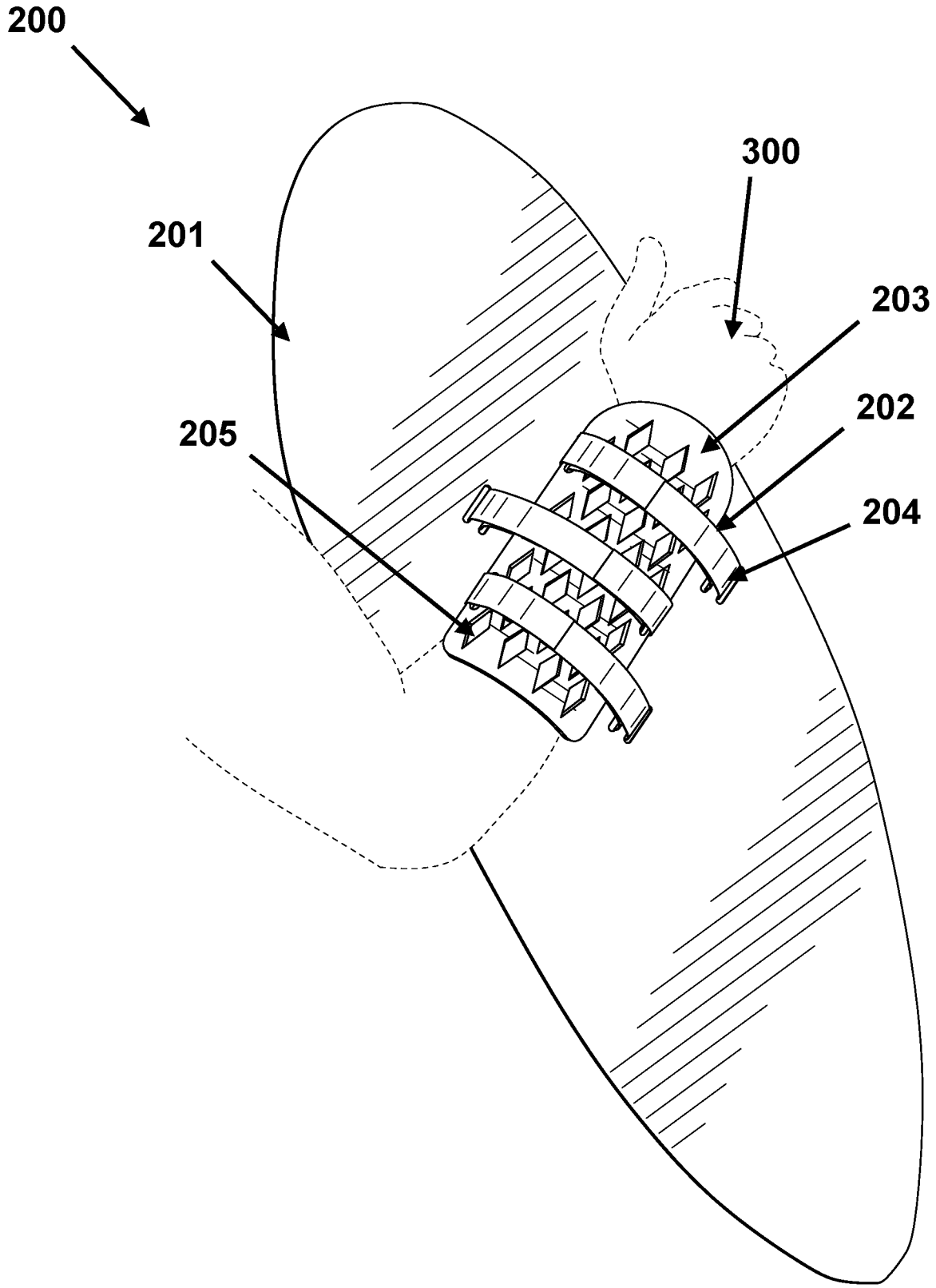
FIG. 9 is a perspective view of a second embodiment of a swimmer wing as worn by a user.
Figure 10:
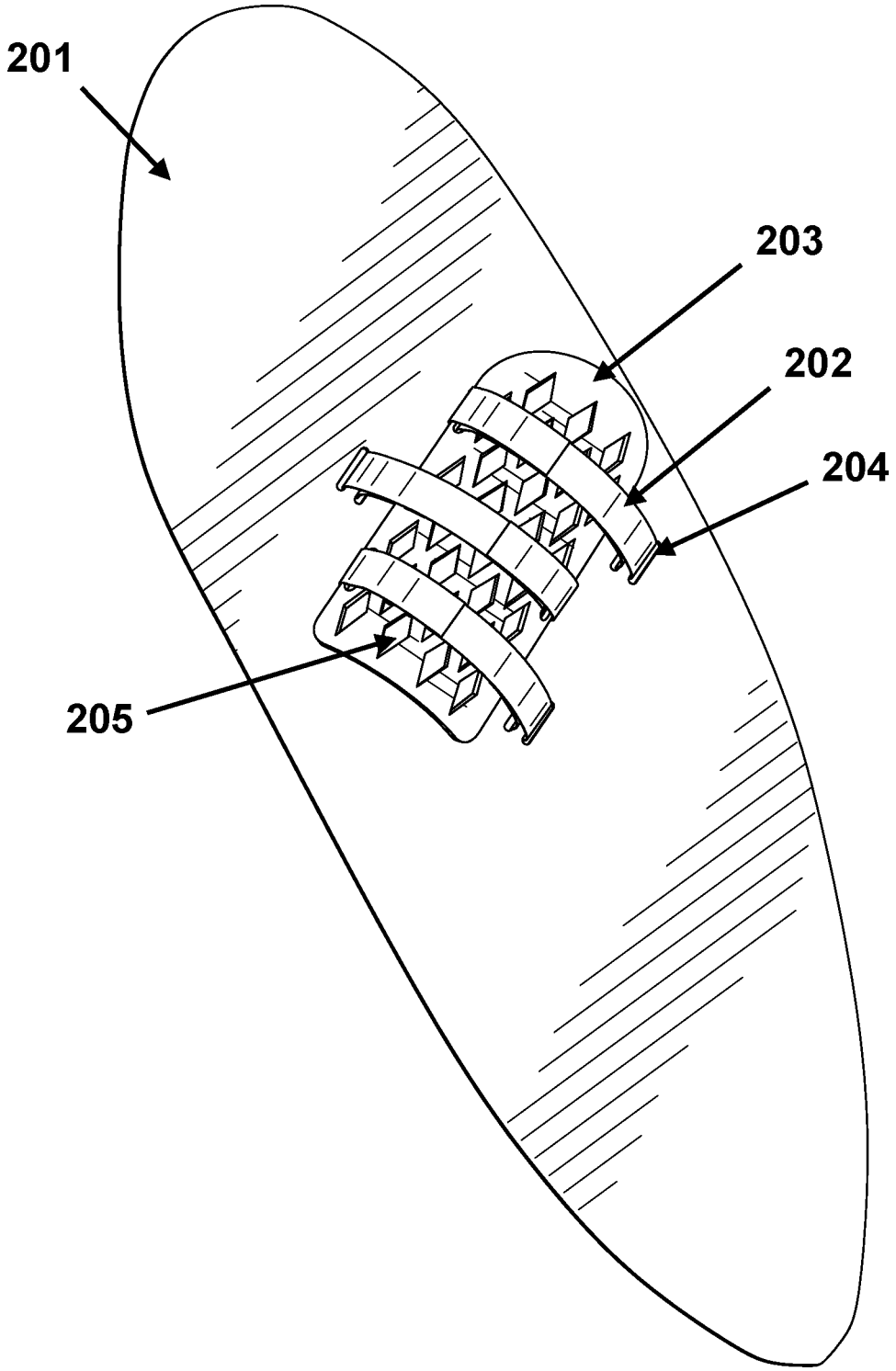
FIG. 10 is a perspective view of a second embodiment of a swimmer wing.
Figure 11:
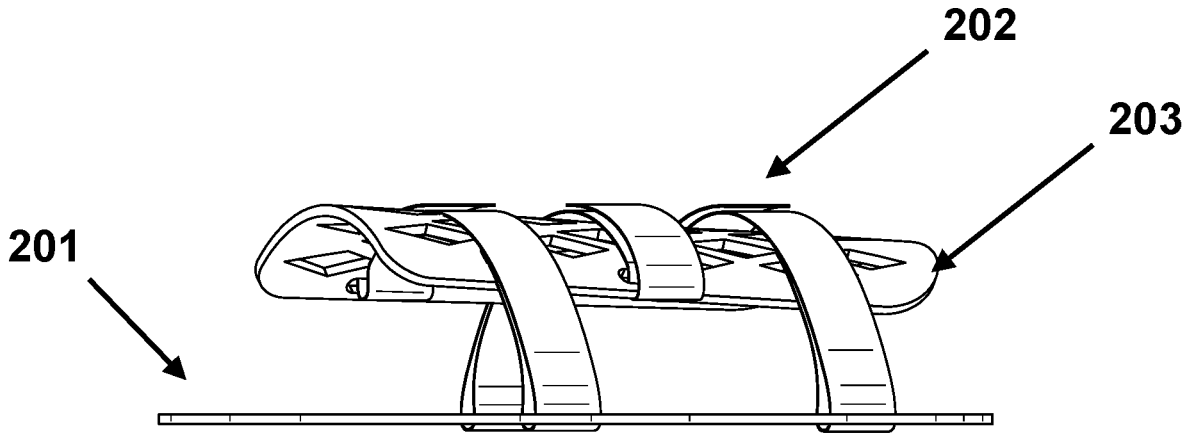
FIG. 11 is a perspective side view of the left side of a second embodiment of a swimmer wing.
Figure 12:
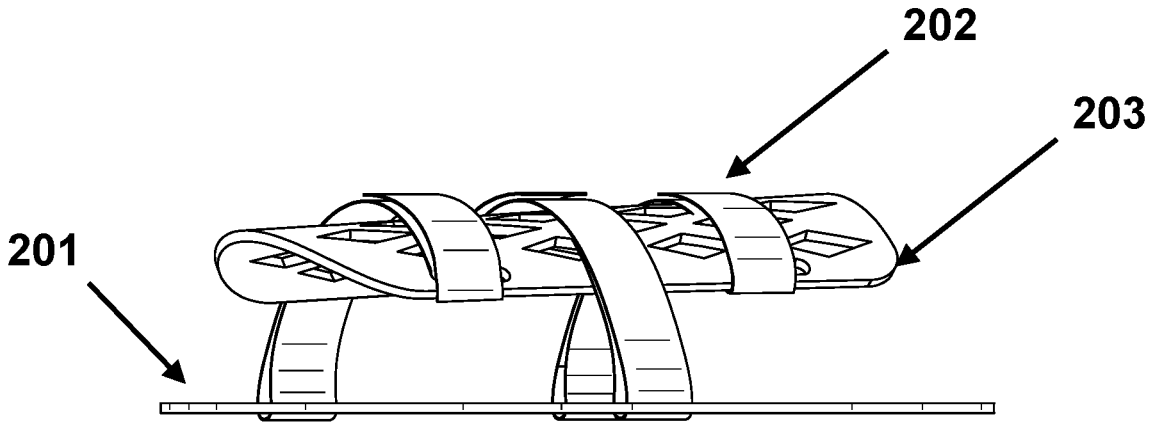
FIG. 12 is a perspective side view of the right side of a second embodiment of a swimmer wing.
Figure 13:
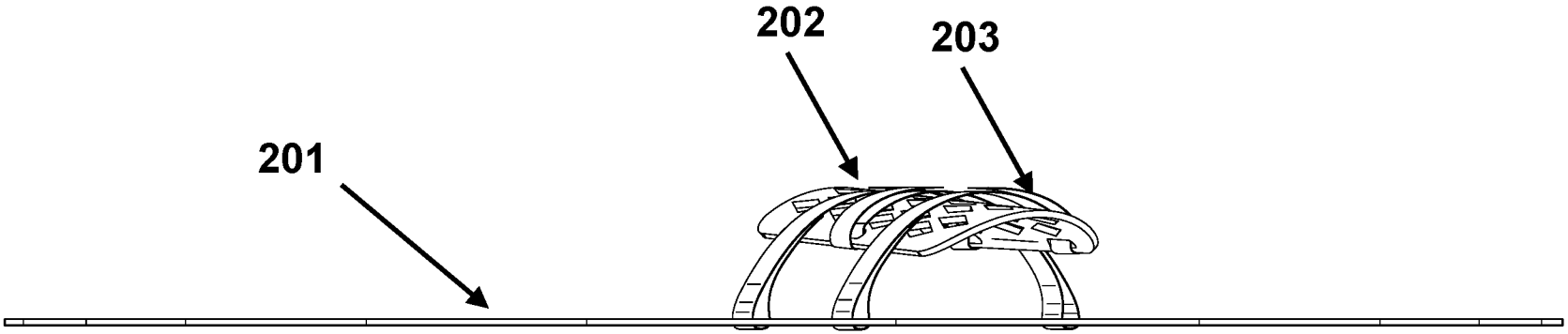
FIG. 13 is a side view of the left side of a second embodiment of a swimmer wing.
Figure 14:
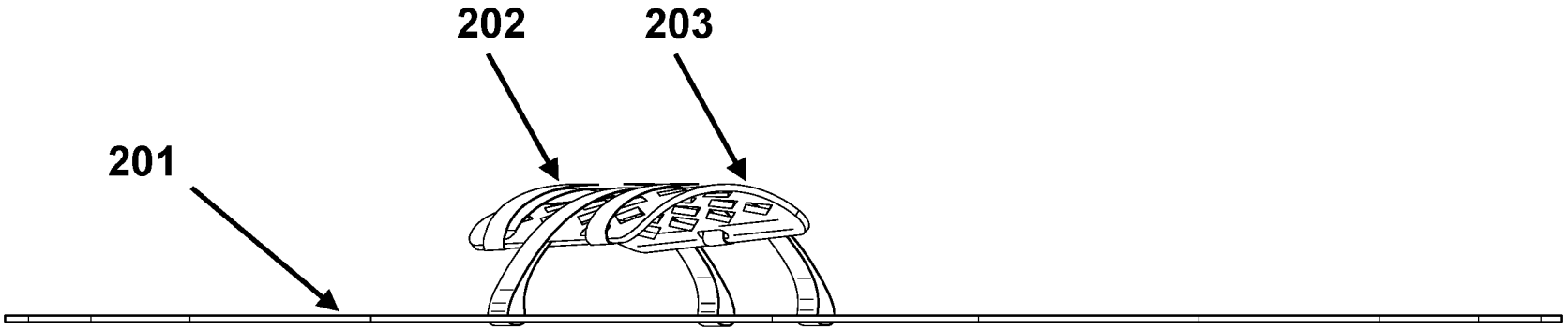
FIG. 14 is a side view of the right side of a second embodiment of a swimmer wing.
Figure 15:
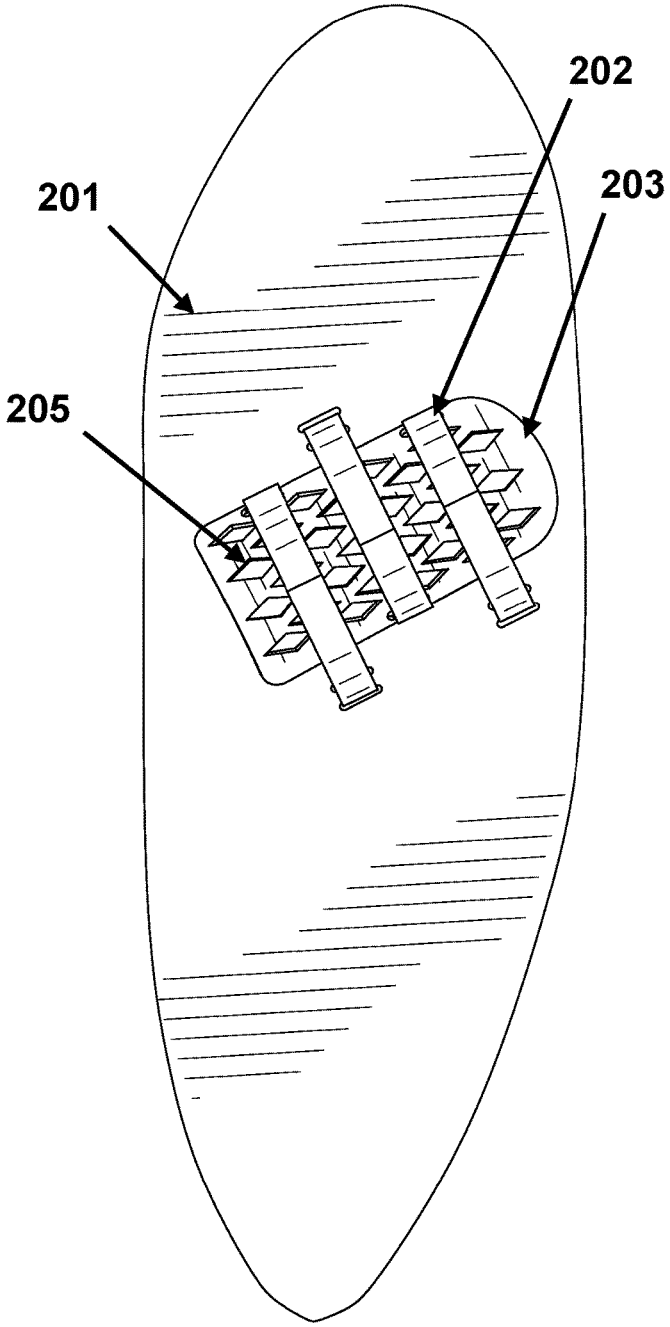
FIG. 15 is a top view of a second embodiment of a swimmer wing.
Figure 16:
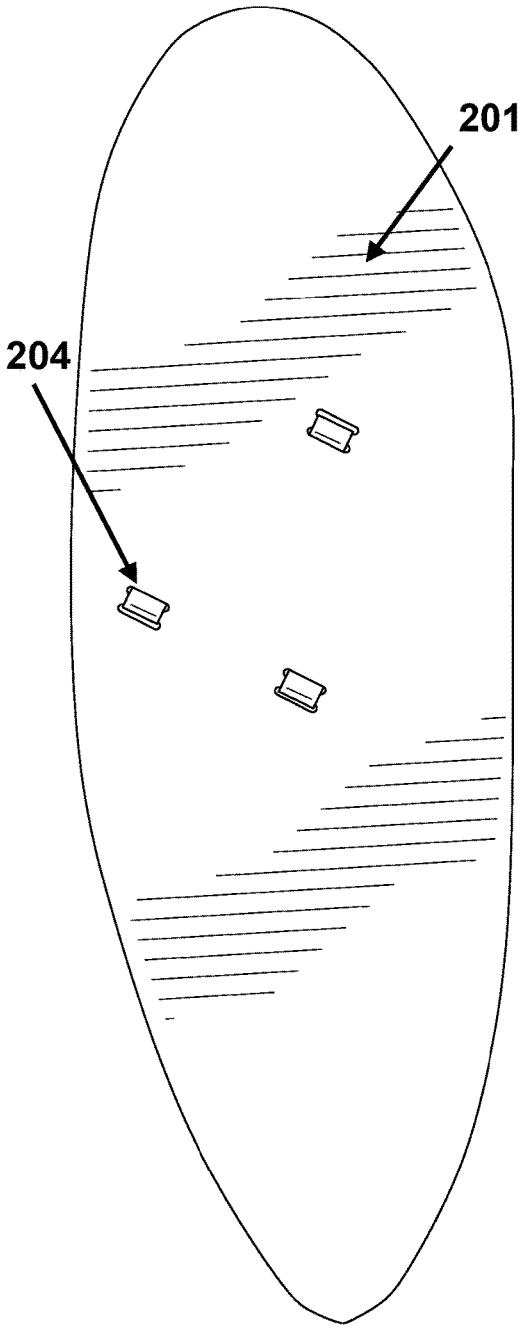
FIG. 16 is a bottom view of a second embodiment of a swimmer wing.

Arm guard 103 may be a rigid plastic shell of uniform construction which is contoured in a convex-concave cup shape having an outer perimeter and inner perimeter. However this is non-limiting and arm guard 103 may be formed in various shapes and sizes such that arm guard 103 covers a substantial or majority portion of a user's forearm. The outer perimeter of arm guard 103 may be affixed to the lower surface of one or more of the bands of arm fasteners 102 by one or more fasteners, adhesive, latches, hinges, or welding techniques. In some embodiments, an insert 119 as illustrated in FIG. 3 may be removably attached to the inner perimeter of arm guard 103. The insert may be of a material that is sweat absorbent, provides an extra layer of cushion, or is adapted to fit a user 300 with a forearm too small or oddly shaped that the user's 300 arm does not properly fit into arm guard 103. The insert may also be customized to fit the individual user's 300 needs or specifically tailored to the situation such as swimming through an ocean. In other non-limiting embodiments insert 119 may be a sleeve made of a durable and thin fabric material such as nylon to provide protection and compression to the arm of the user 330. In some embodiments, swimmer wing 100 may not include arm guard 103, while in other embodiments arm guard 103 may be incorporated into arm fasteners 102 whereby they are one structure.

With reference now to FIG. 9-16, a second exemplary embodiment of the system, system 200, according to the present invention is generally designated. The hook and loop fastener closure system may have one or more hook and loop fastener assemblies 202, each assembly including a flap and a band. The bands may be positioned through apertures 204 in board 201.

Arm guard 203 may include one or more airflow passages to improve ventilation and removal of moisture from the surface of the hand, arm, and wrist. The airflow passages may be in the form of one or more perforations, such as perforations 205 along the body of arm guard 203 having a plurality of apertures throughout the body of arm guard 203. Perforations 205 are designed and arranged to retain the rigidity of arm guard 203. Perforations 205 allow fresh air to circulate through arm guard 203 to wick away sweat as well as built up moisture, reducing the risk of discomfort and rashes. The pattern of perforations 205 is not limited and may have any geometric pattern or be arranged to depict any number of symbols or designs.

In other non-limiting embodiments, arm fasteners may be a binding system comprising one or more binding assemblies each having an arm strap, an arm buckle, and ratchet strap. The arm strap and ratchet strap of each assembly may be affixed to board 101 with, for example but not limited to, fasteners, adhesive, latches, hinges, welding techniques, or any other method known to those skilled in the art whereby the arm strap and ratchet strap are affixed to board 101. The arm strap and ratchet strap may also be affixed to a mounting structure on the surface of board 101. A lower surface of the arm strap may be attached to arm guard 103. One end of the arm strap may be connected to the arm buckle. The ratchet strap may have a series of teeth on the upper surface of the ratchet strap.

The arm buckle may receive the ratchet strap in a sliding engagement that releasably secures the ratchet strap to the arm strap, thereby securing the forearm of user 300 who has positioned their forearm between the arm strap and ratchet strap and board 101. When the arm buckle receives the ratchet strap, the series of teeth on ratchet strap engages with a tab in the buckle whereby the ratchet strap may be pulled by user 300 to further move the ratchet strap through the buckle, tightening the connection between the arm strap and ratchet strap. The ratchet strap however is prevented from moving in the reverse direction, away from the arm buckle and arm strap. To release the ratchet strap from the arm buckle, a sufficient enough force may be applied to a release mechanism on the buckle, the release mechanism including a small button connected to a lever, the lever when activated by the pressing of the button, separating the tab from the teeth on the ratchet strap. The arm strap, ratchet strap, and arm buckle may be made from a suitable polyester based elastomer or equivalent elastomeric polymer; however this is non-limiting and may be made of any material commonly known to those skilled in the art.

In other embodiments arm fasteners 102 may be affixed to board 101 with, for example, fasteners, adhesive, latches, hinges, elastic, laces, welding techniques, or any other method known to those skilled in the art whereby arm fasteners 102 may still provide the necessary structure to hold user's 300 forearm against board 101. In further embodiments, swimmer wing 100 may be positioned on top of user's 300 forearm whereby arm fasteners 102 and arm guard 103 are underneath user's 300 forearm facing upward toward the palm of user's hand.

In the preferred method of use, user 300 obtains two swimmer wings 100. User 300 then places the first of their forearms parallel to first board 101 of first swimmer wing 100 and pulls the band of arm fasteners 102 and arm guard 103 over the user's 300 arm and then wraps the flap over the band to a suitable point that will secure user's 300 arm to board 101. User 300 then attaches the lower surface of the flap to the upper surface of the band securing the user's 300 arm. User 300 then repeats the process for their other forearm, attaching the forearm to second board 101 of the second swimmer wing 100. User 300 then positions themselves in a body of water. In order to swim forward, user 300 utilizes both of swimmer wings 100, extending the user's 300 arms synchronously to propel themselves through the water. When steering, swimmer wings 100 displace reduced volumes of water on the turning side by adjusting stroke breadth or by moving asynchronously, with the duration of stroke shorter on the turning side. User's 300 legs may assist in turning, though turning can be accomplished by swimmer wings 100 alone. In order to turn, user 300 may paddle one swimmer wing 100 less frequently relative to other swimmer wing 100. For example, for a left turn, user 300 would paddle left swimmer wing 100 fewer times than right swimmer wing 100.

When using swimmer wings 100, user 300 may traverse through a body of water with increased mobility and dexterity. Swimmer wings 100 are also advantageous to existing systems and vastly improve user's 300 performance during recreational, navigational, or exercise activities while reducing exertion by user 300.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated.

What is claimed is:

1. A swimmer wing to traverse through a body of water, comprising:

the swimmer wing having a board, the board having a longitudinal axis extending between opposing ends, the board connected to one or more arm fasteners each disposed at a first diagonal angle to the longitudinal axis angled toward a side of the swimmer wing, the one or more arm fasteners connected to an arm guard with a length disposed at a second diagonal angle to the longitudinal axis, the second diagonal angle angled toward an opposite side of swimmer wing from the first diagonal angle, the one or more arm fasteners configured to secure a user's forearm between the board and the arm guard parallel with the length of the arm guard, the arm guard configured to shield a top of the user's forearm, wherein a bottom of the forearm is positioned on the board below the one or more arm fasteners.

2. The swimmer wing of claim 1, the one or more arm fasteners having one or more hook and loop fastener assemblies, the hook and loop fastener assemblies each having a flap and a band, the flap an elongated strip having a patch of gripping fabric comprised of a series of loops and a series of hooks that are configured to mate with each other, the user's forearm positioned between the flap and the band and the board.

3. The swimmer wing of claim 2, the arm guard is a rigid shell contoured in a convex concave shape having an outer perimeter and inner perimeter, wherein a length of the arm guard is longer than a width of the arm guard, the length of the arm guard configured to run parallel to the user's forearm.

4. The swimmer wing of claim 3 further comprising: an insert removably attached to the inner perimeter of the arm guard, the insert configured to facilitate adaption of the user's forearm.

5. The swimmer wing of claim 4, the insert is made of a sweat absorbent material.

6. The swimmer wing of claim 1, the board is curved and ellipse in shape acting as a hydrodynamic wing to generate thrust to the user.

7. The swimmer wing of claim 1, the board is made of wood.

8. The swimmer wing of claim 1, the board is made of carbon fiber, plastics, or composites.

9. The swimmer wing of claim 1, the board is connected to a flexible flap for adjusting a curvature of the swimmer wing to better scoop fluid and increase lift, the flap positioned at a perimeter of the board so that the flap is accessible to the user's forearm when secured in the one or more fasteners.

10. The swimmer wing of claim 1, wherein the board has a roller bar portion at an outer end to provide cushioning and facilitate better grip.

11. The swimmer wing of claim 1, wherein the arm guard shields a majority of a length of the user's forearm.

12. The swimmer wing of claim 1, wherein the arm guard has a plurality of perforations to allow fresh air to circulate through the arm guard.

13. The swimmer wing of claim 1, wherein the arm guard positions the user's forearm along an area of the board such that sides of the user's forearms are not at an edge of the board.

14. The swimmer wing of claim 1, wherein the arm guard is elongated in shape extending over a majority of a lateral axis of the board.

* * * * *